US008177272B2

(12) United States Patent
Schinella, Jr.

(10) Patent No.: US 8,177,272 B2
(45) Date of Patent: May 15, 2012

(54) SNOW/UTILITY SHOVEL HAVING ARRANGEMENTS TO LOCK THE HANDLE AND BLADE TO THE SHAFT IN DIFFERENT ROTATIONAL POSITIONS WHILE PREVENTING AXIAL MOVEMENT THEREBETWEEN

(76) Inventor: Anthony J. Schinella, Jr., Somerset, NJ (US)

( * ) Notice: Subject to any disclaimer, the term of this patent is extended or adjusted under 35 U.S.C. 154(b) by 0 days.

(21) Appl. No.: 12/690,207

(22) Filed: Jan. 20, 2010

(65) Prior Publication Data

US 2011/0175381 A1 Jul. 21, 2011

(51) Int. Cl.

| | |
|---|---|
| ***A01B 1/02*** | (2006.01) |
| ***A01B 1/22*** | (2006.01) |
| ***E01H 5/02*** | (2006.01) |

(52) U.S. Cl. ..... 294/53.5; 294/54.5

(58) Field of Classification Search ..... 294/51, 294/53.5, 54.5, 55, 55.5, 58, 59, 60; 37/285; D8/10; 172/375

See application file for complete search history.

(56) References Cited

U.S. PATENT DOCUMENTS

| | | | | | |
|---|---|---|---|---|---|
| 3,222,699 | A | * | 12/1965 | Zeisig | 294/54.5 |
| 3,226,149 | A | * | 12/1965 | McJohnson | 294/50 |
| 5,185,992 | A | * | 2/1993 | Garcia | 56/400.04 |
| 5,447,349 | A | * | 9/1995 | Coble | 294/58 |
| D381,778 | S | * | 7/1997 | Semo | D30/162 |
| D381,875 | S | * | 8/1997 | Spear et al. | D8/10 |
| D395,927 | S | * | 7/1998 | Freelander | D8/10 |
| 5,915,482 | A | * | 6/1999 | Carruthers | 172/375 |
| D413,774 | S | * | 9/1999 | Spear | D8/10 |
| 5,951,078 | A | * | 9/1999 | Whitehead et al. | 294/54.5 |
| 5,984,393 | A | * | 11/1999 | Washington | 294/53.5 |
| 6,086,049 | A | * | 7/2000 | Sheils | 294/59 |
| 6,199,245 | B1 | * | 3/2001 | Blessing | 294/57 |
| 6,237,258 | B1 | * | 5/2001 | Biro | 294/53.5 |
| 6,709,234 | B2 | * | 3/2004 | Gilbert et al. | 415/200 |
| D554,958 | S | * | 11/2007 | Kelley et al. | D8/13 |
| 7,571,945 | B2 | * | 8/2009 | Walker et al. | 294/51 |
| 2003/0184104 | A1 | * | 10/2003 | Ping | 294/57 |

* cited by examiner

*Primary Examiner* — Paul T Chin

(74) *Attorney, Agent, or Firm* — Richard M. Goldberg

(57) ABSTRACT

An ergonomic shovel that has a curved, bent angle shaft that reduces the user's exertion, strain and fatigue. In addition, when not in use, shovel provides a space saving design so it can be stored nearly flat, saving storage space. This is accomplished by rotating the handle and blade 90 degrees in one direction with the use of quick release detent pins that are easily removed and re-inserted at predetermined positions.

14 Claims, 3 Drawing Sheets

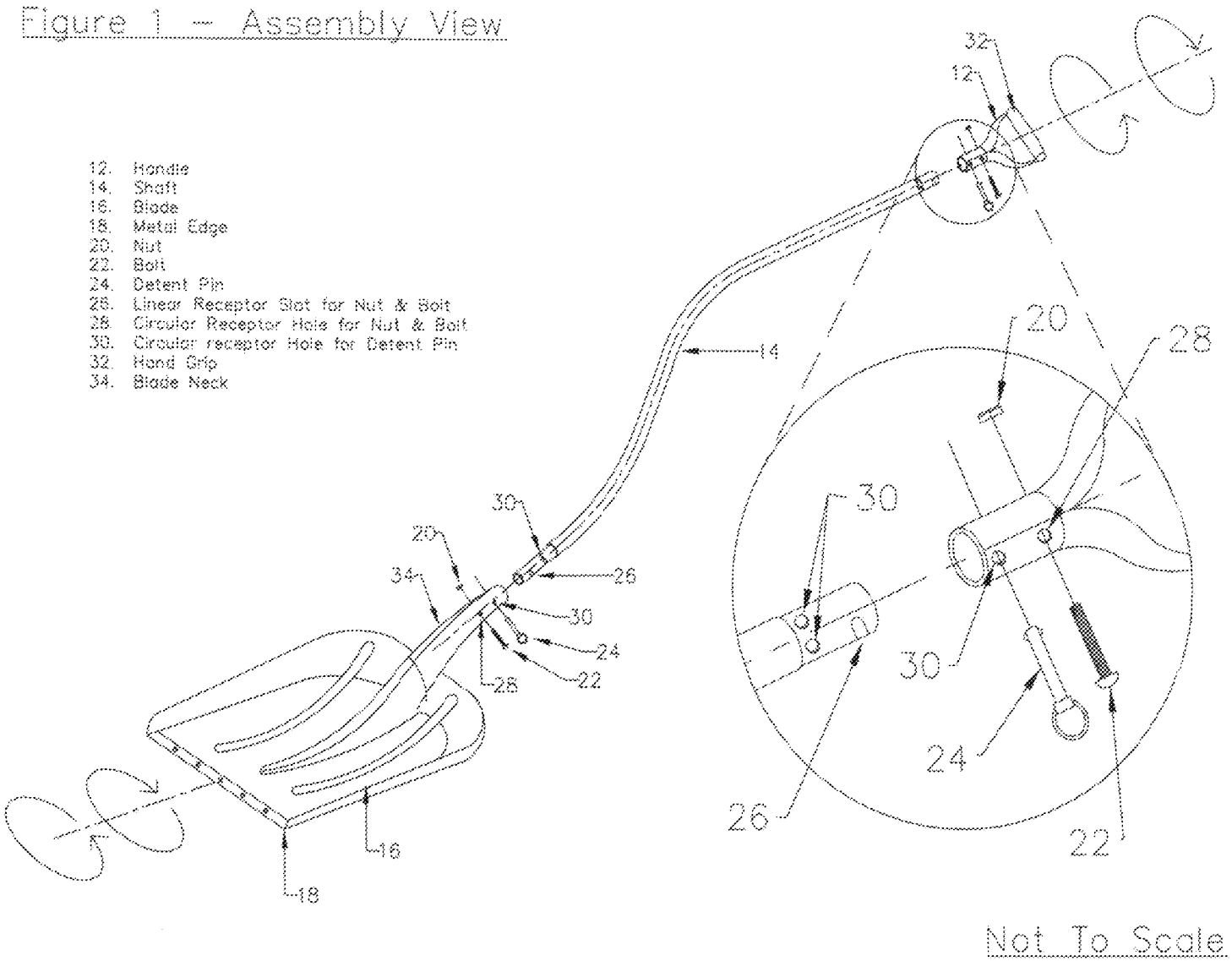
Figure 1 — Assembly View
12. Handle
14. Shaft
16. Blade
18. Metal Edge
20. Nut
22. Bolt
24. Detent Pin
26. Linear Receptor Slot for Nut & Bolt
28. Circular Receptor Hole for Nut & Bolt
30. Circular Receptor Hole for Detent Pin
32. Hand Grip
34. Blade Neck Figure 2 – Side & Top Views
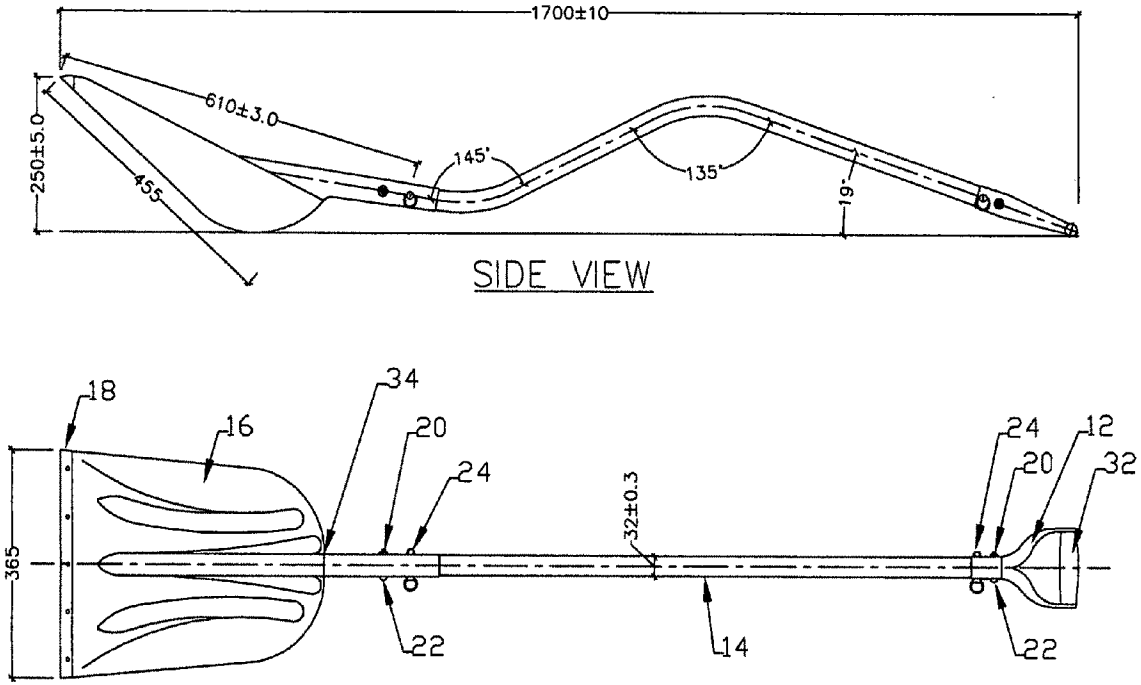
12. Handle
14. Shaft
16. Blade
18. Metal Edge
20. Nut
22. Bolt
24. Detent Pin
26. Linear Receptor Slot for Nut & Bolt
28. Circular Receptor Hole for Nut & Bolt
30. Circular receptor Hole for Detent Pin
32. Hand Grip
34. Blade Neck
Not To Scale

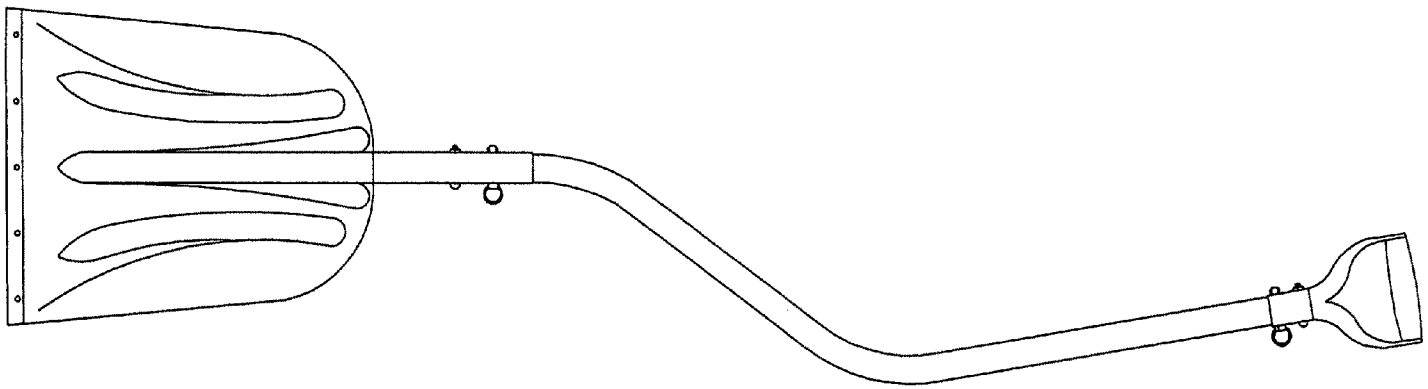
Figure 3 – Storage View
Not To Scale

SNOW/UTILITY SHOVEL HAVING ARRANGEMENTS TO LOCK THE HANDLE AND BLADE TO THE SHAFT IN DIFFERENT ROTATIONAL POSITIONS WHILE PREVENTING AXIAL MOVEMENT THEREBETWEEN

RELATED APPLICATIONS

The present application is related in subject matter to United States provisional patent application, serial number 20080185857, filed Aug. 7, 2008, for SNOW SHOVEL WITH ANGULARLY ADJUSTABLE BLADE, by Wesley Westgarde, included by reference herein.

The present application is related to U.S. Pat. No. 5,984, 393, issued Nov. 16, 1999, for SHOVEL WITH PIVOTING HEAD, by Rodney H. Washington, included by reference herein.

The present application is related to U.S. Pat. No. D381, 875, issued May 5, 1997, for SNOW SHOVEL, by Kenneth J. Spear, Bryan S. Ritchie, included by reference herein.

The present application is related in subject matter to United States provisional patent application, serial number US 2003/0184104A1, filed Oct. 2, 2003, for FOLDABLE SHOVEL, by Qiu Jian Ping (CN), included by reference herein.

The present application is related to U.S. Pat. No. D487, 680 S, issued Sep. 27, 2009, for TELESCOPING SNOW SHOVEL, by Vicki Sickler, Gregory S. Phililips, included by reference herein.

The present application is related to U.S. Pat. No. 7,571, 945 B2, issued Aug. 11, 2009, for COLLAPSIBLE SHOVEL, included by reference herein.

The present application is related in subject matter to United States provisional patent application, serial number US 2007/0013198 A1, filed Jan. 18, 2007, for SNOW SHOVEL, by Louis-George Brazeau (CA), included by reference herein.

The present application is related to U.S. Pat. No. 6,315, 341 B1, issued Nov. 13, 2001, for SHOVEL HAVING AN ADJUSTABLE BLADE ANGLE, by Sandra Leon, Felix Leon, included by reference herein.

The present application is related to U.S. Pat. No. 6,290, 273 B1, issued Sep. 18, 2001, for ARTICULATED SNOW SHOVEL, by Marius Moisan (CA), included by reference herein.

The present application is related to U.S. Pat. No. D417, 825, issued Dec. 21, 1999, for SNOW TOOL, by Thomas Tisbo, Stephen P. Whitehead, Lyle Rosine, included by reference herein.

FIELD OF THE INVENTION

The present invention relates to a curved shaft ergonomic shovel, more particularly, to reduce user effort and strain, and to be stored nearly flat, saving storage space.

BACKGROUND OF THE INVENTION

The shovel is a basic manual tool that been used since the dawn of civilization. Stone Age man used the shoulder blades of bison to dig mines and Ancient Romans used the first iron shovels to dig aqueducts. The shovel has two main functions: 1) for digging holes or trenches into the earth and, 2) to move/transport loose material from one place to another. In its most basic form, the shovel has a flat, wide piece rigid material attached to the end of a straight shaft. The user grips the shaft with both hands, generally 12"-24" apart, for the appropriate leverage in order to maneuver the shovel. Nearly every human being has invariably used a shovel at some time in their lives. Whether it be to dig a hole, to shovel snow or even digging in the sandbox, it is a very common, useful and popular tool.

The design of shovels has not changed much over hundreds of years. When shoveling snow or any loose material, the straight shaft forces the user to unnecessarily bend over, exerting full body strain, possibly resulting in neck, back, arm and leg injuries. This has a negative impact on our country's economy as many millions of dollars are lost each year due to missed productivity at work and medical expenses. Current day snow shovels are generally made with inferior materials resulting in further disadvantages to the user.

Blades made of polypropylene plastic are weak and crack easily. They also wear out quickly where the blade is scraped along the surface that is being shoveled. It is the same plastic used to make food containers, plastic bags, carpeting and product packaging.

Another problem is the connection hardware. The handle and blade usually have one or two rivets or screws that secure them to the shaft. Over time, the force exerted on the shovel causes this connection to fail. The result is a shovel blade that sways or wobbles unbalanced while the user is trying to move loose materials. The neck of the blade into which the shaft inserts, can also crack under the weight and pressure of use.

As can be seen, this creates great frustration for the user in the sense that it takes much more time and effort by having their body perform extra work to overcome these deficiencies. It also leads to unnecessary expense as the user must continually buy new shovels after the previous ones failed them.

In recent years, the term "ergonomic" shovel has been presented as an alternative to the straight shaft shovel. Here, the shaft is shaped like a lazy "S" or a lazy "Z". With this configuration, the intent is for the user to exert less effort and bend less. However, there are still disadvantages. Current shovel shafts are not long enough and possess only a slight curvature and angle. These two attributes still force the user to bend over considerably in order to have the shovel blade make contact with the ground. When said shovels are not in use and stored by leaning against, or hanging on a wall, they comprise unnecessary space. The curvature of the shaft prohibits the shovel from laying flat against a surface which can discourage consumers from purchasing such products.

The present application addresses and solves all of the aforementioned problems in the following manner:

The blade to be manufactured from ABS (Acrylonitrile Butadiene Styrene) plastic instead of the typical poly (polypropylene) plastic. ABS plastic possesses standing impact strength and high mechanical strength. It is commonly used to manufacture safety helmets, piping and car components. It is highly resistant to most chemicals, abrasion and fractures, and provides strength and longevity. Aluminum is another choice, appealing for being relatively lightweight and durable.

The shaft is installed into the blade and handle and secured with connecting nuts and bolts that are inserted from opposite ends through the diameter of the connection. The threaded (male) bolt, screws into the threaded (female) nut, then tightened. Next a quick release (detent) pin is inserted through receptor holes in the blade/shaft and handle/shaft connections and serves two purposes. First, to add extra stability and strength to the connections. Second, to enable the user to quickly convert the shovel from "use" mode to "storage" mode by turning the handle and blade 90 degrees. This allows the shovel to occupy less cubic space since it can now lay nearly flat against a wall, on the floor, or in a vehicle.

Last, the curvature angles of the shaft and the linear length of the shaft, are both increased allowing users of all heights to stand erect while shoveling.

Other U.S. patents and patent applications have attempted to distinguish themselves from ordinary snow shovels and offer effort reducing benefits as in United States Patent Application Nos. US 2008/0185857 A1, US 2007/0187964 A1, US 2007/0013198 A1, U.S. Pat. No. 6,315,431 B1 and U.S. Pat. No. 6,290,273 B1 in which the shovel has an angularly adjustable blade or U.S. Pat. No. 5,984,393 named "Shovel with Pivoting Head". U.S. Pat. No. 417,825 titled "Snow Tool" and U.S. Pat. No. 381,875 titled "Snow Shovel" which are simple bent angle shovels. U.S. Pat. No. D487,680 S titled "Telescoping Snow Shovel" has a collapsing shaft.

The aforementioned U.S. Patents and U.S. Patent Applications attempt to add ergonomic features to shovels. Some unnecessarily add small parts and mechanisms that do not particularly belong on a shovel. Since shovels are generally exposed to tremendous force and impact, there is a higher propensity for failure of these parts such as springs and the like. Such designs can over-complicate a manual tool to the point where it is not cost effective for production.

With others, the angle of the blade may pivot allowing the user the capability to discharge the material to their left or right side. This awkwardness has the potential to create even more strain than if using a basic, straight shaft shovel. Varying blade angles may require an unnatural response to the user, resulting in the use of body positions and muscles that are uncomfortable and unnatural.

Telescoping shafts are designed so that one can easily transport it in a car, backpack, etc. They are compact and comprise less space, but non-ergonomic, as they have very short, straight shafts. Therefore, said shovels are inappropriate relating to the means set forth in this application.

SUMMARY OF THE INVENTION

In accordance with the present invention, there is provided an ergonomic shovel that has a curved, bent angle shaft that greatly reduces the user's exertion, strain and fatigue. When not in use, said shovel provides a space saving design so it can be stored nearly flat, saving valuable storage space. This is accomplished by turning/rotating the handle and blade 90 degrees in one direction. Quick release detent pins are easily removed, the handle and shaft are rotated, then the pins are re-inserted for easy conversion from "use" to "storage" positions.

It would be advantageous to provide a curved shaft ergonomic shovel that requires the user to perform minimal effort and bending.

It would also be advantageous to provide such a shovel that stores nearly flat.

It would further be advantageous to provide a shovel that not only moves snow, but many other loose materials such as dirt, sand, mulch, stone, etc.

Another advantage is to have such a shovel with components that will not wear down, crack or otherwise fail.

Yet, another advantage is to apply this design and use, to be applied to other manual tool attachments such as garden rakes, leaf rakes, brooms, pitchforks, hoes and the like.

BRIEF DESCRIPTION OF THE DRAWINGS

A complete understanding of the present invention may be obtained by reference to the accompanying drawings, when considered in conjunction with the subsequent, detailed description, in which:

FIG. 1 is a front perspective view of a shovel with an exploded view of the "shaft to handle" connection. this same exploded view is similar to the "shaft to blade" connection;

FIG. 2 is a top view of a shovel in the lower drawing and a side view in the upper drawing; and FIG. 3 is a front view of a shovel in the storage position in which the handle and blade are rotated 90 degrees allowing the shovel to lie nearly flat.

For purposes of clarity and brevity, like elements and components will bear the same designations and numbering throughout the Figures.

DESCRIPTION OF THE PREFERRED EMBODIMENT

The present invention can be configured to be any type of manual garden tool, as the shaft 14, can be inserted into end attachments such as rakes, pitch forks, hoes, brooms and the like. With this configuration, manual home and garden tools can be converted into effort reducing, space saving instruments. However, this present invention is particularly well adapted for use as a shovel to move snow and other loose materials. As a result, the present device will be described in a snow shovel configuration in order to set forth the best mode contemplated for this device.

Parts Described:

FIG. 1 is a front perspective view of shovel.

FIG. 2 is a side view of shovel in the upper drawing and top view of shovel in the lower drawing.

FIG. 3 is a front view of shovel in "storage" position.

Referring to FIG. 1, a snow shovel is provided with a handle 12, a shaft 14 and a blade 16. Handle 12 is where a user grips with one hand for maneuverability, stability and leverage. Shaft 14 inserts into handle 12 and blade 16. Blade 16 is used to move or transport snow.

The top section of shaft 14 (male) inserts into handle 12 (female). Bottom end of shaft 14 (male) inserts into blade 16 (female).

Referring to FIG. 1, exploded view, shaft 14 has a linear receptor slot for nut and bolt 26 near top end of shaft 14. This slot will accept nut 20 and bolt 22 after handle 12 is installed onto shaft 14.

Handle 12 has circular receptor holes for nut 20 and bolt 22 drilled through opposite sides of handle 12 and lie parallel to hand grip 32. Circular receptor holes for nut 20 and bolt 22 similarly exist on blade neck 34.

After handle 12 and upper end of shaft 14 are inserted into each other, circular receptor holes for nut 20 and bolt 22 on handle 12 and linear receptor slot for nut and bolt 26 on shaft 14, are aligned. This allows for the installation of nut 20 and bolt 22 through the connected handle 12 and shaft 14. Bolt 22 in inserted into one hole and nut 20 is inserted into opposite hole. They are threaded together and tightened.

Similarly, after blade 16 and lower end of shaft 14 are inserted into each other, circular receptor holes for nut 20 and bolt 22 on blade neck 34 and linear receptor slot for nut and bolt 26 on lower end of shaft 14 are aligned. This allows for the installation of nut 20 and bolt 22 through connected blade 16 and shaft 14. Nut 20 and bolt 22 is installed, threaded into each other, and tightened. Both handle 12 and blade 16 can now rotate clockwise or counterclockwise 90 degrees, and have a stopping point due to the precise length of linear receptor slot for nut and bolt 26.

Referring to FIG. 1, exploded view, circular receptor holes in shaft 14 are located below linear receptor slot for nut and bolt 26. Circular receptor holes for detent pins are also located on handle 12 below nut 20 and bolt 22. These two holes lie directly opposite each other on both shaft 14 and handle 12. When handle 12 and shaft 14 are joined together, the holes will align to accept insertion of detent pin 24. Similarly, circular receptor holes for detent pin 24 are located near end of the blade neck 34. Detent pin 24 allows the quick removal and re-installation for securing in the "use" or "storage" position. This positioning is dependent upon how handle 12 and blade 16 are rotated.

Referring to FIG. 2, side view: This position is referred to as the "use" position.

Referring to FIG. 3, front view: After detent pins are removed from handle 12 and blade 16, both can turn 90 degrees clockwise or counterclockwise. This enables the shovel to be stored nearly flat and is referred to as the "storage" position. Detent pins also supplement the shovel's strength by further reinforcing connecting nut 20 and bolt 22.

Referring to FIG. 2, side view, shaft 14 has two angular bends. The first angle, closest to handle 12, measures 135 degrees. The lower angle closest to blade 16 measures approximately 145 degrees. Linear length of shaft 14 is approximately 44" and constructed of powder coated steel for rust protection. Handle 12 is constructed of powder coated steel and has a wooden hand grip 32. Blade 16 is constructed of ABS plastic or aluminum. Bolt 22, nut 20, detent pin 24 and steel wear strip 18 on edge of blade 16 are constructed of zinc plated steel.

As previously mentioned, this design can allow other tool heads such as brooms, rakes, pitch forks and hoes, to be interchanged on the bottom end of shaft 14. Another ergonomic benefit is that the user has the choice of gripping handle 12 in two ways. Handle 12 may be parallel to the ground in which the user grips in the "underhand" position. Or the handle 12 can be perpendicular to the ground in which the user grips in the "handshake" position. Both positions provide ergonomic benefits so that the user's wrist can be comfortably employed.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A shovel comprising:
- a blade;
- a handle;
- a shaft;
- a first connection arrangement which connects a lower end of the shaft to the blade;
- a second connection arrangement which connects an upper end of the shaft to the handle; and
- at least one of the first and second connection arrangements including:
  - a first arrangement which connects the shaft to a respective one of said blade and handle in a manner that prevents relative axial movement between the shaft and the respective one of said blade and handle while permitting relative rotational movement between the shaft and the respective one of said blade and handle, wherein said first arrangement includes:
    - a) an arcuate opening extending partially along a circumference of one of:
      - i) the shaft, and
      - ii) at least one of the blade and handle;
    - b) an axially locking opening in the other of:
      - i) the shaft, and
      - ii) at least one of the blade and handle; and
    - c) a pin for engagement within the axially locking opening and the arcuate opening to prevent relative axial movement between the shaft and the respective one of said blade and handle while permitting relative rotational movement between the shaft and the respective one of said blade and handle for a rotational angle defined by said arcuate opening; and
  - a second arrangement separate from said first arrangement which releasably locks the shaft and the respective one of said blade and handle in one of a plurality of desired rotational orientations around an axis of the shaft.

2. A shovel according to claim 1, wherein said arcuate opening extends for an angle of approximately 90 degrees.

3. A shovel according to claim 1, wherein said second arrangement includes:
- a) a plurality of circumferentially arranged openings in one of:
  - i) the shaft, and
  - ii) at least one of the blade and handle;
- b) at least one rotationally locking opening in the other of:
  - i) the shaft, and
  - ii) at least one of the blade and handle;
- c) a removable pin for engagement within one said circumferentially arranged opening and one said rotationally locking opening to releasably lock the shaft and the respective one of said blade and handle in one of a plurality of desired rotational orientations around an axis of the shaft.

4. A shovel according to claim 3, wherein said plurality of circumferentially arranged openings and said at least one rotationally locking opening are axially displaced from said first arrangement.

5. A shovel comprising:
- a blade;
- a handle;
- a shaft;
- a first connection arrangement which connects a lower end of the shaft to the blade;
- a second connection arrangement which connects an upper end of the shaft to the handle; and
- at least one of the first and second connection arrangements including:
  - a first arrangement which connects the shaft to a respective one of said blade and handle in a manner that prevents relative axial movement between the shaft and the respective one of said blade and handle while permitting relative rotational movement between the shaft and the respective one of said blade and handle, wherein said first arrangement includes:
    - a) an arcuate opening extending partially along a circumference of one of:
      - i) the shaft, and
      - ii) at least one of the blade and handle;
    - b) a projection extending from the other of:
      - i) the shaft, and
      - ii) at least one of the blade and handle for engagement within the arcuate opening to prevent relative axial movement between the shaft and the respective one of said blade and handle while permitting relative rotational movement between the shaft and the respective one of said blade and handle for a rotational angle defined by said arcuate opening; and a second arrangement separate from said first arrangement which releasably locks the shaft and the respective one of said blade and handle in one of a plurality of desired rotational orientations around an axis of the shaft.

6. A shovel according to claim 5, wherein said second arrangement includes:

i) a plurality of circumferentially arranged openings in one of:

A) the shaft, and

B) at least one of the blade and handle;

ii) the circumferentially arranged openings being axially offset from said arcuate opening; and iii) at least one rotationally locking opening in the other of:

A) the shaft, and

B) at least one of the blade and handle; and iv) a removable pin for engagement within one said circumferentially arranged opening and one said rotationally locking opening to releasably lock the shaft and the respective one of said blade and handle in one of a plurality of desired rotational orientations around an axis of the shaft.

7. A shovel according to claim 5, wherein said arcuate opening extends for an angle of approximately 90 degrees.

8. A shovel according to claim 5, wherein said second arrangement includes:

i) a plurality of circumferentially arranged openings in one of the shaft and at least one of the blade and handle, the circumferentially arranged openings being axially offset from said arcuate opening; and ii) a removable projection extending from the other of the shaft and at least one of the blade and handle, for engagement within one of the circumferentially arranged first openings to releasably lock the shaft and the respective one of said blade and handle in one of a plurality of desired rotational orientations around an axis of the shaft.

9. A shovel according to claim 8, wherein said arcuate opening extends for an angle of approximately 90 degrees.

10. A shovel according to claim 1, wherein said second arrangement includes:

a) a plurality of circumferentially arranged first openings in one of:

i) the shaft, and ii) at least one of the blade and handle;

b) a removable projection extending from the other of:

i) the shaft, and ii) at least one of the blade and handle for engagement within one of the circumferentially arranged first openings to releasably lock the shaft and the respective one of said blade and handle in one of a plurality of desired rotational orientations around an axis of the shaft.

11. A shovel according to claim 1, wherein said shaft has a substantially S-shape, with a first bend near said handle and a second bend near said blade.

12. A shovel according to claim 11, wherein said first bend is approximately 135 degrees and said second bend is approximately 145 degrees.

13. A shovel according to claim 1, wherein said handle has a substantially D-shape.

14. A shovel according to claim 1, wherein both the first and second connection arrangements each include the first arrangement and the second arrangement.

* * * * *